United States Patent [19]

Larsson

[11] Patent Number: 4,749,051

[45] Date of Patent: Jun. 7, 1988

[54] DRILL STEEL

[75] Inventor: Lars E. Larsson, Sandviken, Sweden

[73] Assignee: Santrade Limited, Luzern, Switzerland

[21] Appl. No.: 780,198

[22] Filed: Sep. 26, 1985

[30] Foreign Application Priority Data

Oct. 1, 1984 [SE] Sweden ..... 8404888

[51] Int. Cl.[4] ..... E21B 10/00; B23B 31/04

[52] U.S. Cl. ..... 175/320; 175/323; 408/226

[58] Field of Search ..... 175/320, 323, 324, 325; 408/59, 226, 229

[56] References Cited

U.S. PATENT DOCUMENTS

| | | | |
|---|---|---|---|
| Re. 16,061 | 5/1925 | Thurston | 175/320 |
| 1,666,898 | 4/1928 | Hanson . | |
| 2,029,447 | 2/1936 | Swain | 408/226 |
| 2,177,300 | 10/1939 | Kellegrew | 175/325 |
| 2,217,202 | 10/1940 | Gelpcke | 255/63 |
| 2,479,698 | 8/1949 | Paguin | 175/323 |
| 2,733,943 | 2/1956 | Nater | 287/125 |
| 2,895,355 | 7/1959 | Kleine | 408/59 |

FOREIGN PATENT DOCUMENTS

| | | | |
|---|---|---|---|
| 0189901 | 5/1957 | Austria | 175/320 |
| 2349831 | 4/1975 | Fed. Rep. of Germany | 175/323 |
| 2454261 | 5/1976 | Fed. Rep. of Germany | 175/323 |
| 1157386 | 5/1958 | France | 175/320 |
| 6509828 | 1/1967 | Netherlands | 175/323 |
| 807819 | 1/1959 | United Kingdom . | |
| 0847197 | 9/1960 | United Kingdom | 408/226 |

*Primary Examiner*—Stephen J. Novosad
*Assistant Examiner*—Terry Lee Melius
*Attorney, Agent, or Firm*—Burns, Doane, Swecker & Mathis

[57] ABSTRACT

A drill steel for percussion drilling has four longitudinally extending grooves for removal of cuttings. The grooves are shaped such that, in comparison with a hexagonal drill steel, there is obtained an enlarged space for cuttings and a less consumption of material with maintenance of the same resistance to bending.

8 Claims, 2 Drawing Sheets

DRILL STEEL

BACKGROUND AND OBJECTS OF THE INVENTION

The present invention relates to a drill steel for percussion drilling having four longitudinally extending and circumferentially spaced passages for removal of cuttings.

Usually, the now used drill steels for percussion drilling, in the mining industry as well as for different kinds of contract work, are either round or hexagonal. The earlier rather usual square shape with higly bevelled corners is now seldom used. Drill steels of these types are disclosed in for instance U.S. Pat. No. 2,733,943.

During recent years hydraulic rock drilling machines are to an increasing extent replacing pneumatic rock drilling machines in percussion drilling of this type. The result of such a change is that the drilling velocity is highly increased, roughly doubled, i e in the same time as one meter was drilled by means of a pneumatic rock drilling machine now two meters are drilled by means of a hydraulic rock drilling machine. Due to the roughly doubled drilling rate, thus, the removal of cuttings per time unit has to be doubled.

In small hole drills for percussion drilling in concrete, brock, stone and similar material it has been proposed to provide the drill with a plurality of concave grooves along which the drilling dust is transported. The diameter of the drill basically coincides with the diameter of the bore hole. Therefore, the primary object of this drill design is to form the convex portions between the concave grooves such that a friction as small as possible does arise against the bore hole wall at the same time as straight holes are produced. The removal of drilling dust and the stresses in the steel, then, are in no way critical factors. Drills of the last-mentioned type are disclosed in for instance U.S. Pat. No. 1,666,898 and U.S. Pat. No. 2,217,202.

The object of the present invention is to provide a drill steel which has an enlarged space for drillings compared to that in conventional drill steels.

Another object of the invention is to provide a drill steel which, in comparison with conventional drill steels, for the same resistance to bending has less material consumption.

A further object of the invention is to provde a drill steel which is well adapted to be twisted so as to create auger characteristics, which often is of advantage in drilling operations in loose kinds of rocks and in non-homogenous or cracked rock formations.

A still further object of the invention is to provde a drill steel which makes possible a collar-shank design which is favourable with respect to arising stresses.

THE DRAWING

The invention is described in detail in the following description with reference to the accompanying drawings in which two embodiments are shown by way of example. It is to be understood that these embodiments are only illustrative of the invention and that various modifications thereof may be made within the scope of the claims.

In the drawings, FIG. 1 shows a side view, partly in section, of the rear portion of a drill steel according to the invention provided with shank and collar.

DETAILED DESCRIPTION OF A PREFERRED EMBODIMENT OF THE INVENTION

Figure 1:
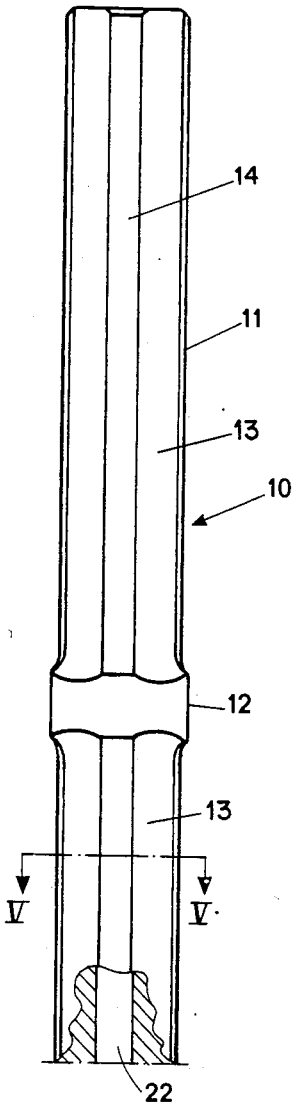

In FIG. 1 the drill steel generally denoted by 10 comprises a rear section defined by a shank 11 adapted for insertion into a drill sleeve in a rock drilling machine and a radially expanded collar 12 adapted to rest against the drill sleeve and separating the shank from a front section of the drill steel. Drill steels of this type are often used in rock drilling machines which usually have separate motors for rotating the drill steel. The drill rod can either be adapted to be interconnected with another drill rod forming part of a drill string or be an integral drill steel.

Figure 2:
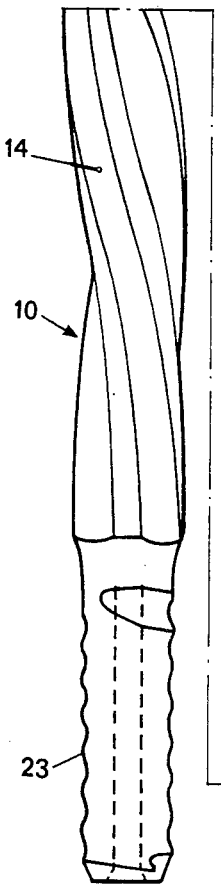
FIG. 2 and FIG. 3 show the forward and rear portion, respectively, of another embodiment of a drill steel according to the invention.
Figure 3:
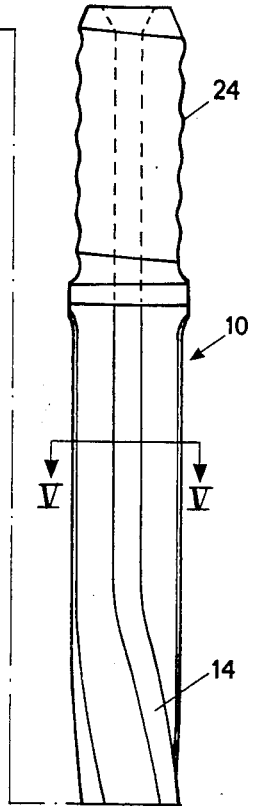

In FIGS. 2 and 3 the drill steel generally denoted by 10 is an extension drill rod adapted to be connected to another extension drill rod in a drill string over threaded portions 23, 24 by means of coupling sleeves. The threads, then, can either be turned on the rolled drill steel, as is the portion 23, or turned on a forged rod end, as is the portion 24.

Figure 4:
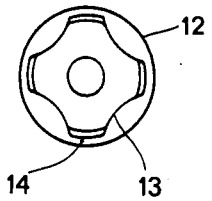
FIG. 4 shows a rear end view of the drill steel in FIG. 1.
Figure 5:
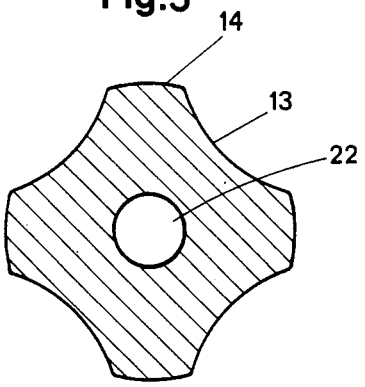
FIG. 5 shows on an enlarged scale a section taken on the line V—V in FIG. 1 and FIG. 3.

As shown in FIGS. 4 and 5 the drill steel 10 is provided with four grooves 13, which extend in the longitudinal direction of the drill steel along the front and rear sections thereof. The grooves are equally spaced in the circumferential direction of the drill steel. The cuttings produced during drilling are intended to be removed along the grooves 13. In a preferred embodiment the grooves 13 are concave and the peripheral portions 14 located between two concave grooves 13 are convex.

In the illustrated embodiments the diameter d of the drill steel 10 is X·D, where D is the diameter of an equilateral hexagon 15, i e a polygon having six sides of equal length, said hexagon intersecting or at least being tangential to a peripheral portion 14 located between two grooves 13, and where X can vary between 0.85 and 1 with preference for values between 0.94 and 0.98. When it is said that the hexagon 15 shall intersect or be tangential to the portion 14 it is to be understood that this means that the portions of adjacent sides 17, 18 nearest to a corner 16 shall intersect the portion 14 or at least be tangential to the portion 14 by means of the corner 16 or tangential to the transitions 19 between the portion 14 and the grooves 13 by means of the sides 17, 18.

In the illustrated embodiments, further, the groove 13 extends inwardly of the hexagon 15 at least at the largest depth of the groove, i e at the largest distance h of the groove 13 from a straight line 21 interconnecting the transitions 19 of the groove to the portions 14. The distance h is y·d, where d is the diameter of the drill steel 10 and y can vary between 0.05 and 0.10, with preference for values between 0.06 and 0.08. In the preferred embodiment the grooves 13 are concave and the portions 14 convex having radii of curvature R and r, i e d/2, respectively, which are substantially of equal size. The factor X is preferably in the order of 0.96 and the factor y preferably in the order of 0.07.

The concave portions 13 are substantially larger than the convex portions 14, preferably substantially twice as long. The concave and convex portions 13, 14 extend along the entire axial extent of the envelope surface of the drill steel 10, i e along the whole length of the drill steel except for connecting portions adapted for connection to other drill rods, drill bit and, when applicable, rock drilling machine. The connecting portion to be connected to the drill bit can be threaded or conical. Alternatively, in integral drill steel, the drill steel and the drill bit can be integrally joined.

Figure 6:
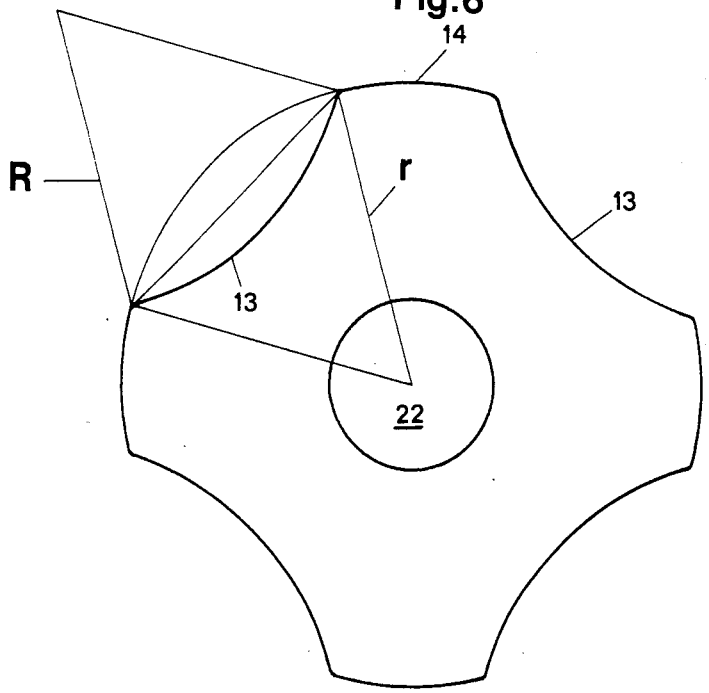
FIG. 6 and FIG. 7 illustrate in different ways the profile of a preferred embodiment of a drill steel according to the invention.

The illustrated embodiment can be derived as shown in FIG. 6. An equilateral triangle having the side length equal with the radius 4 of the circle is inscribed in a 60 degree sector of a circle. Then, a similar equilateral triangle is construed having a base which coincides with the side of the firstmentioned triangle forming a chord. The top of the lastmentioned triangle is the centre for a circular arc having the radius R, which forms the concave groove 13. The centre of the circular arc 13, then, is at the distance $r \cdot \sqrt{3}$ from the centre of the drill steel. The length of the circular arc 13, then is a sixth of the circumference of the circle. Four similar circular arcs are construed equally spaced around the circumference of the circle. Thus, the length of each of the four convex portions 14 is half the length of a concave portion. For a drill steel where the convex portions 14 form parts of a circumscribed circle, generally, the cross section area of the drill steel 10, including the area of the central flushing passage 22, is between 50% and 85% of the area of the circle, with preference for values between 65% and 85%.

Figure 7:
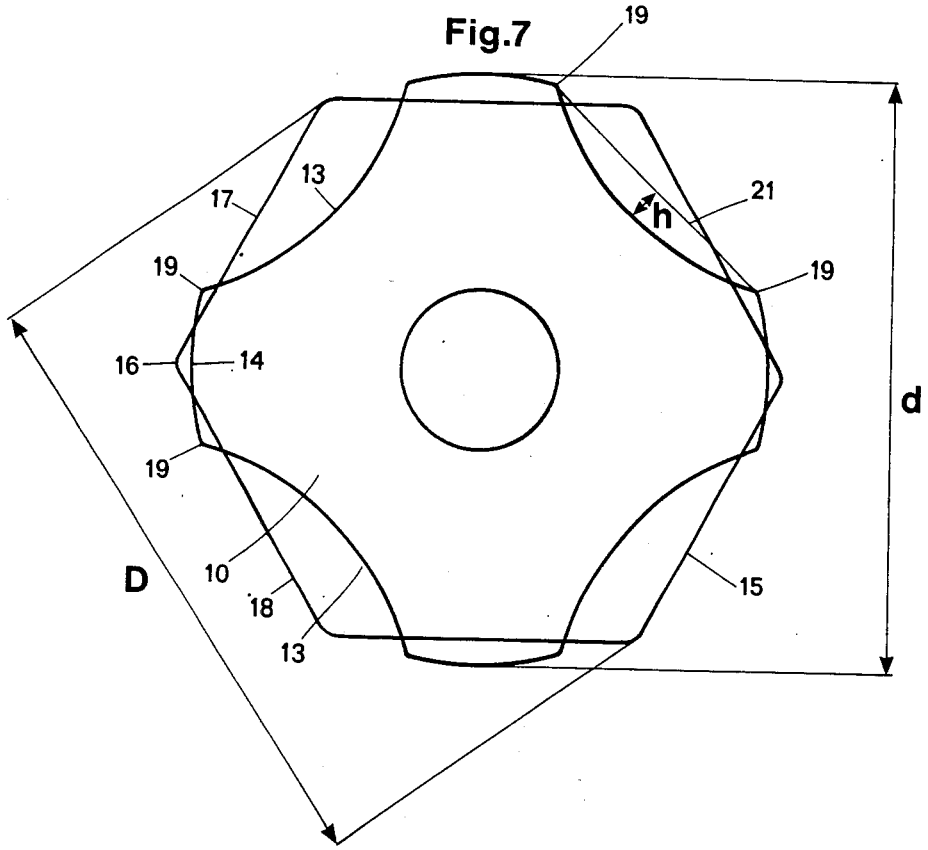

As shown in FIG. 7 the space for the drillings is considerably larger in a drill steel according to the invention than in a hexagonal drill steel. In comparison with a hexagonal drill steel a drill steel according to the invention has almost three percent lower weight for the same resistance to bending, which is a certainly not nonessential saving from a drill steel cost point of view.

In the embodiment shown in FIG. 1 the portions 13, 14 extend straightly in the longitudinal direction of the drill steel. In the embodiment shown in FIGS. 2 and 3 the drill steel is twisted, thereby creating auger characteristics. A drill steel having such shape is believed to decrease the risk for the drill steel to get stuck and the risk for the drill steel to become bent during drilling in loose rocks and fissured rock formations. In order to amplify this auger effect, when suitable, fins can be provided on two opposed convex portions 14. In the hexagonal drill steel design of today having shank and collar a high linear stress arises due to wedge action, whichc causes damages due to jamming and premature breakage. Due to the concave identation which is obtained in a design according to the invention an almost perpendicular abutment at the transferring of the torque does arise between the drill sleeve of the rock drilling machine and the drill steel shank 12. Further, it is believed to be possible to improve the straightness of the bore hole in bench drilling and long hole drilling if a drill rod according to the invention is used as the first rod, i e the drill rod nearest to the drill bit, said drill rod having a length of say 0.5, 1.0 or 1.5 meter and a diameter which is only slightly less than the diameter of the drill bit.

I claim:

1. Percussion drill steel for percussion drilling comprising front and rear sections separated by a radially enlarged collar, said rear section defining a shank adapted to be inserted into a drill sleeve for being rotatably driven thereby, said shank comprising four longitudinally extending, substantially longitudinally straight, circumferentially spaced concave grooves, the portions of said shank disposed between circumferentially adjacent ones of said grooves include longitudinally straight outer peripheral surfaces which are of convex cross-section, said grooves being larger than said peripheral surfaces in the circumferential direction.

2. A drill steel according to claim 1, wherein said front section includes four longitudinally extending substantially longitudinally straight, circumferentially spaced concave grooves aligned with said grooves of said shank.

3. A drill steel according to claim 1, wherein said grooves have substantially the same radius of curvature as said peripheral surfaces.

4. A drill steel according to claim 1, wherein said grooves are substantially twice as long in the circumferential direction as said peripheral surfaces.

5. Percussion drill steel for percussion drilling comprising front and rear sections separated by a radially enlarged collar, said rear section defining a shank adapted to be inserted into a drill sleeve for being rotatably driven thereby, said shank comprising four longitudinally extending, substantially longitudinally straight, circumferentially spaced concave grooves, said front section including four longitudinally extending, substantially longitudinally straight, circumferentially spaced concave grooves aligned with said grooves of said shank.

6. A drill steel according to claim 5 wherein the portions of said rear section disposed between circumferentially adjacent ones of said grooves include longitudinally straight outer peripheral surfaces which are of convex cross-section.

7. A drill steel according to claim 5, wherein said grooves are larger than said peripheral surfaces in the circumferential direction.

8. Percussion drill steel for percussion drilling comprising front and rear sections separated by a radially enlarged collar, said rear section defining a shank adapted to be inserted into a drill sleeve for being rotatably driven thereby, said shank comprising four longitudinally extending, substantially longitudinally straight, circumferentially spaced concave grooves, the portions of said shank disposed between circumferentially adjacent ones of said grooves include longitudinally straight outer peripheral surfaces which are of convex cross-section, said grooves having substantially the same radius of curvature as said peripheral surfaces. --

* * * * *